US006726144B2

(12) United States Patent
Squires

(10) Patent No.: US 6,726,144 B2
(45) Date of Patent: Apr. 27, 2004

(54) RIBBON CORE AND SPINDLE

(75) Inventor: Milo B. Squires, Chaska, MN (US)

(73) Assignee: DataCard Corporation, Minneapolis, MN (US)

( * ) Notice: Subject to any disclaimer, the term of this patent is extended or adjusted under 35 U.S.C. 154(b) by 0 days.

(21) Appl. No.: 10/308,238

(22) Filed: Dec. 2, 2002

(65) Prior Publication Data

US 2003/0127555 A1 Jul. 10, 2003

Related U.S. Application Data

(60) Provisional application No. 60/342,919, filed on Dec. 21, 2001.

(51) Int. Cl.[7] ..... B65H 18/10; B65H 75/30

(52) U.S. Cl. ..... 242/597.6; 242/611.2; 400/242

(58) Field of Search ..... 242/597.6, 611.2; 400/242

(56) References Cited

U.S. PATENT DOCUMENTS 3,106,363 A 10/1963 Epstein
3,722,929 A * 3/1973 Gilman ..... 242/597.6
5,062,579 A * 11/1991 Noguchi ..... 242/597.6
5,439,303 A * 8/1995 Alday ..... 400/242
6,109,801 A 8/2000 Mabit
2001/0042810 A1 * 11/2001 Christensen et al. ..... 242/597.6

FOREIGN PATENT DOCUMENTS

JP 08039912 2/1996

OTHER PUBLICATIONS

U.S. patent application Ser. No. 10/308,244, entitled "Radio Frequency Identification Tags on Consumable Items Used in Printers and Related Equipment," filed Dec. 2, 2002.

* cited by examiner

*Primary Examiner*—John M. Jillions
(74) *Attorney, Agent, or Firm*—Merchant & Gould P.C.

(57) ABSTRACT

Core and spindle technology for use with ribbon materials. The invention has use in many environments in which a ribbon or sheet material is wound onto a core, for example in printers and related equipment used to produce data bearing identity documents. The core and spindle are constructed to prevent the core from locking on the spindle as a result of the core contracting as ribbon material is wound onto the core. The core and spindle permits contraction of the core without squeezing or binding the core to the spindle, so that the core can easily be removed from the spindle once the ribbon is wound onto the core.

5 Claims, 3 Drawing Sheets

RIBBON CORE AND SPINDLE

PRIORITY INFORMATION

This application claims the benefit of U.S. Provisional Application No. 60/342,919 filed Dec. 21, 2001.

FIELD OF THE INVENTION

This invention relates to consumable ribbon materials, particularly in printers and related equipment. More particularly, the invention relates to an improved core and spindle for ribbon materials used in equipment, such as printers, for producing data bearing identity documents, including cards such as identification cards, drivers licenses, credit cards and the like, and booklets such as passports and the like.

BACKGROUND OF THE INVENTION

Ribbon materials, such as printing ribbons, cleaning tape, index tape, labels, topping foil, and holographic overlay tape, used in printers and related equipment for producing data bearing identity documents are known. The ribbon material is usually supplied from a supply roll, and, after use, is wound onto a take-up roll. The take-up roll typically comprises a cylindrical core or spool that is mounted on a spindle which is driven in rotation so as to wind used ribbon material onto the core as the ribbon is used. The core is intended to slide on and off of the spindle so that the core can be easily inserted onto and removed from the spindle.

A problem with existing core and spindle technology is that as the ribbon material is wound onto the core, the ribbon material compresses the core radially inward, causing the core to contract. As the core contracts, the interior surface of the core engages the exterior surface of the spindle with an increasing compression force. In effect, the core squeezes the spindle as the ribbon material is wound onto the core. When this occurs, removal of the core from the spindle is difficult if not impossible. Often times, the compression force is so great that the ribbon material must be unwound from the core, while the core is still disposed on the spindle, until the compression force is removed, at which point the core can be removed from the spindle. A similar problem can occur with supply rolls when new ribbon material is being wound onto a supply roll core disposed on a spindle.

Therefore, there is a need for improved core and spindle technology for ribbon materials that prevents the core from being squeezed onto the spindle as ribbon material is wound onto the core, thereby facilitating removal of the core from the spindle.

SUMMARY OF THE INVENTION

The invention provides improvements relating to core and spindle technology for use with ribbon materials. The invention has use in many environments in which a ribbon or sheet material is wound onto a core. In the preferred embodiment, the ribbon materials are those associated with printers and related equipment used to produce data bearing identity documents, including cards such as identification cards, drivers licenses, credit cards and the like, and booklets such as passports and the like. Examples of ribbon materials include printing ribbons, cleaning tape, index tape, labels, topping foil, and holographic overlay tape. The invention is beneficial for both ribbon take-up rolls in which used ribbon material is wound onto the core, as well as ribbon supply rolls in which new or unused ribbon material is wound onto the core.

In one aspect of the invention, a core for ribbon material is provided. The core comprises a hollow cylinder having a first open end and a second open end, an exterior surface and an interior surface, and a plurality of circumferentially spaced ribs connected to and extending inwardly from the interior surface.

In yet another aspect of the invention, a spindle for receiving a core thereon is provided. The spindle comprises a cylindrical member having a first exterior surface, and a plurality of ridge members extending outwardly from the first exterior surface. Each ridge member has sidewalls and an outer wall between the sidewalls. The outer walls of the ridge members define a second exterior surface, and the ridge members are spaced from each other so that facing sidewalls of adjacent ridge members define a channel between each adjacent ridge member.

In still another aspect of the invention, a combination of a core and spindle is provided. The core, which is to receive ribbon material thereon, includes a hollow cylinder having a first open end and a second open end, an exterior surface upon which ribbon material is to be wound, and an interior surface. In addition, a plurality of circumferentially spaced ribs are connected to and extend inwardly from the interior surface. The spindle, which is to receive the core thereon, includes a cylindrical member having a first exterior surface, and a plurality of ridge members extending outwardly from the first exterior surface. Each ridge member has sidewalls and an outer wall between the sidewalls. The outer walls of the ridge members define a second exterior surface, and the ridge members are spaced from each other so that facing sidewalls of adjacent ridge members define a channel between each adjacent ridge member. Further, the channels are sized to receive the ribs in close fitting relation, and, when the core is disposed on the spindle, a gap is provided between an inner edge of each rib and a base of each channel.

For a better understanding of the invention, its advantages and objects obtained by its use, reference should be made to the drawings which form a further part hereof, and to the accompanying description, in which there is described a preferred embodiment of the invention.

DETAILED DESCRIPTION OF THE INVENTION

The invention relates to a core and spindle for use with ribbon material that prevents squeezing of the core onto the spindle as the ribbon material is wound onto the core. In the preferred embodiment, the core and spindle are used with ribbon materials that are used in the production of data bearing identity documents, including cards such as identification cards, drivers licenses, credit cards and the like, and booklets such as passports and the like. Examples of ribbon materials to which the invention applies includes, but is not limited to, mono-chromatic or multi-color printing ribbons, cleaning tape, index tape, labels, topping foil, and holographic overlay tape. The types of equipment that utilize these ribbon materials includes printers and laminators, as well as peripheral equipment utilized with printers and laminators.

The core and spindle of the present invention can form part of a take-up roll, in which use ribbon material is wound onto the core, or form part of a supply roll, in which new or fresh ribbon material is wound onto the core.

In order to describe the inventive concept, the invention will be described herein in relation to a core and spindle of a print ribbon take-up roll in a printer that is used in the production of data bearing identity documents. It is to be understood, however, that the invention is applicable to many other types of equipment that utilize a core and spindle.

Figure 1:
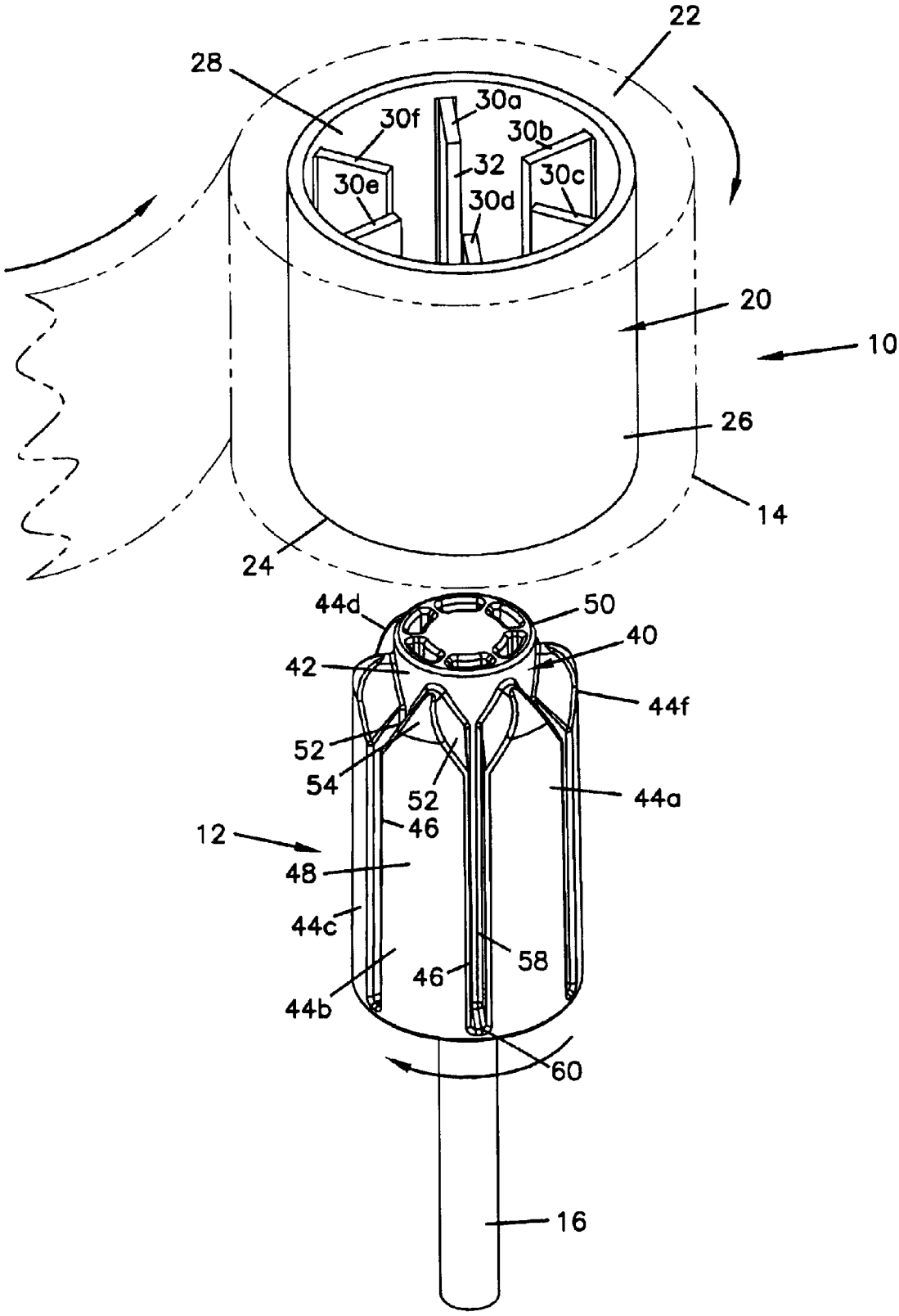
FIG. 1 illustrates a core and spindle according to the present invention.

FIG. 1 illustrates a core 10 and a spindle 12 for use in a printer. Used print ribbon 14, illustrated in dashed lines, is wound onto the core 10 as the core 10 is rotated in the direction of the arrow by the spindle 12. The core 10 thus acts as a take-up roll for the ribbon 14 as it is used up by an upstream printhead (not shown) of the printer. The print ribbon 14 is supplied by a supply roll (not shown) that is positioned upstream of the printhead.

The print ribbon 14, which is illustrated in dashed lines in FIG. 1, preferably comprise a series of differently colored panels, such as cyan, yellow, magenta, and black. Alternatively, the print ribbon 14 comprises a single, solid color, i.e. monochromatic. The spindle 12 is mounted so as to be rotatably driven by a shaft 16 via a motor, such as a stepper motor (not shown), in known fashion. The core 10 is designed to interact with the spindle 12 such that as the spindle 12 is driven in rotation, the core 10 is simultaneously rotated with the spindle 12 whereby the print ribbon 14 is wound onto the core 10.

Figure 2:
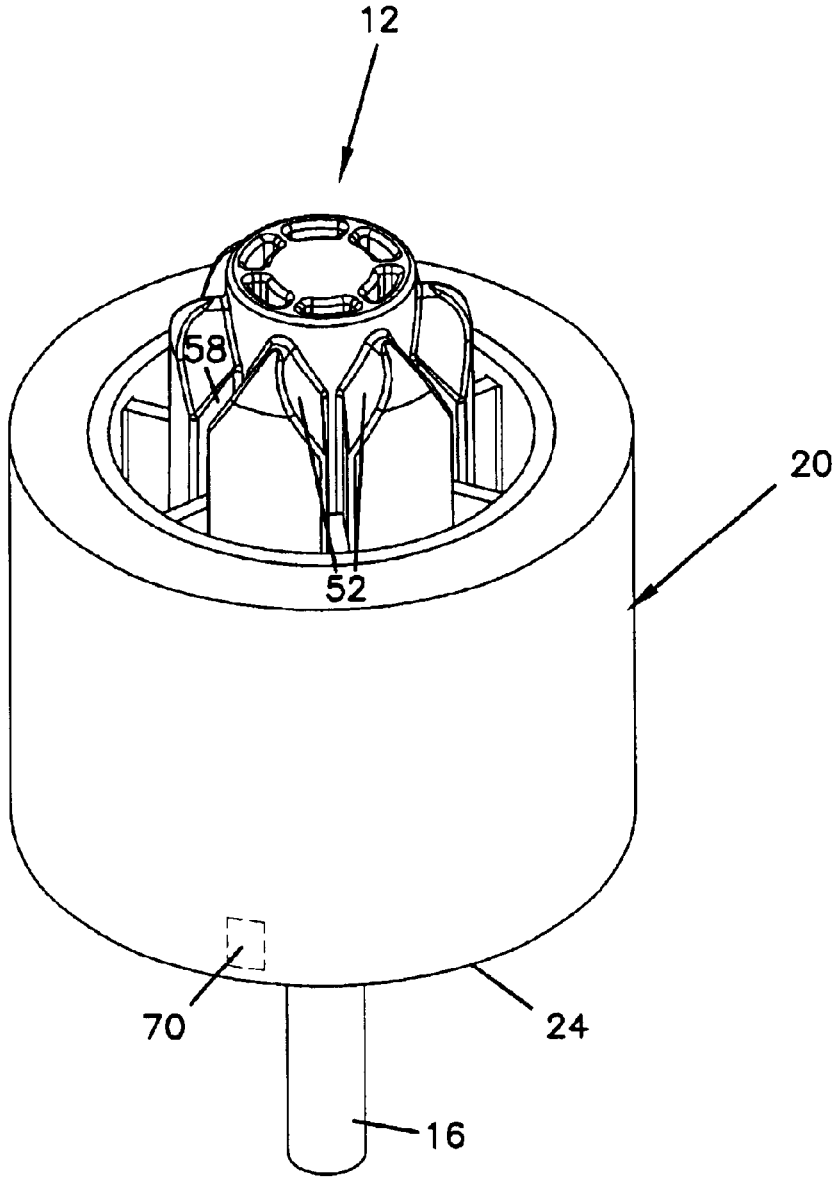
FIG. 2 illustrates the core disposed on the spindle.
Figure 3:
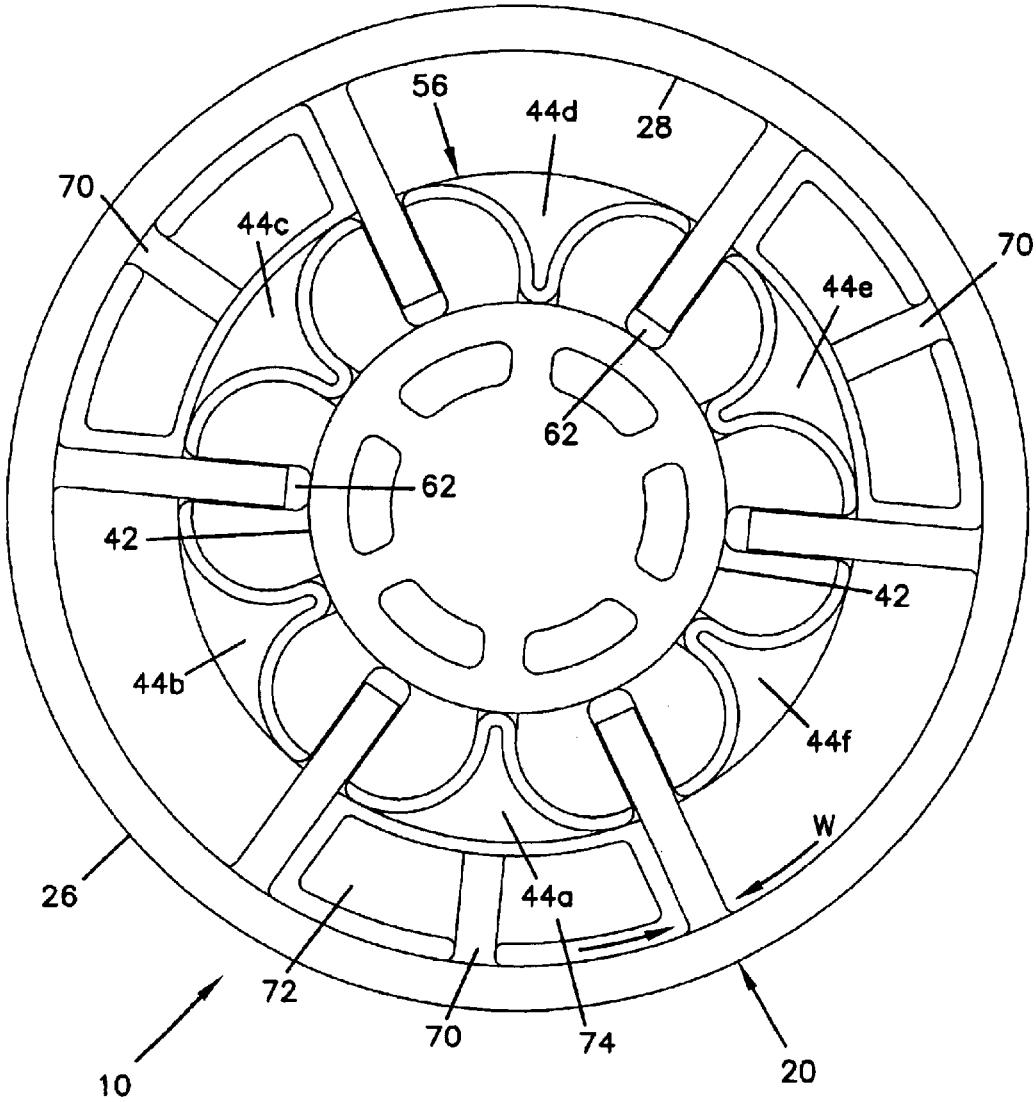
FIG. 3 is a top view of the core and spindle.

With reference to FIGS. 1–3, the core 10 is seen to include a generally hollow cylinder 20 having a first open end 22 and a second open end 24. The cylinder is preferably made from a plastic material. The cylinder 20 further includes an exterior surface 26 and an interior surface 28. The exterior surface 26 of the cylinder 20 is preferably designed to enhance the effectiveness of the take-up of the used ribbon 14 onto the cylinder 20. For example, the exterior surface 26 can be an increased friction surface, such as by providing a layer of high friction rubber material on the exterior surface 26. Alternatively, the exterior surface 26 can be provided a slightly rough texture to increase the friction thereof.

A plurality of ribs 30*a–f* project radially inward from the interior surface 28 of the cylinder 20 toward the central axis of the cylinder. The ribs 30*a–f* are rectangular in shape and extend from adjacent the first end 22 to adjacent the second end 24. As shown in FIG. 1, the ribs 30*a–f* stop short of the end 22 so that they are recessed relative to the end 22. Similarly, the ribs 30*a–f* stop short of the end 24 so that they are recessed relative to the end 24. The area between the ends of the ribs 30*a–f* and the ends 22, 24 provides space to allow insertion and seating of a radio frequency identification tag (not shown) completely within the cylinder 20 at one or both ends 22, 24 of the cylinder. A radio frequency identification tag suitable for use with the core 10 is described in U.S. patent application Ser. No. 10/308,244 filed on Dec. 2, 2002 entitled Radio Frequency Identification Tags On Consumable Items Used In Printers And Related Equipment.

As best seen in FIG. 3, the ribs 30*a–f* are arranged so that each rib is positioned diametrically opposite another rib. For example, rib 30*a* is diametrically opposite the rib 30*d*, rib 30*b* is diametrically opposite rib 30*e*, and rib 30*c* is diametrically opposite rib 30*f*. Thus, the embodiment illustrated in FIGS. 1–3 includes three pairs of diametrically opposed ribs. However, it is to be realized that a larger or smaller number of ribs could be utilized. Further, when an odd number of ribs, for example three ribs, are used, the diametrically opposed positioning of the ribs cannot be used.

The ribs 30*a–f* each extend radially inward approximately the same distance to an inner edge 32. The distance is selected so that when used ribbon 14 is wound onto the cylinder 20 and the cylinder is compressed, the inner edges 32 do not engage the surface 42 of the spindle 12 as will be described below. Likewise, in the non-compressed condition of the cylinder, shown in FIG. 3, the inner edges 32 do not engage the spindle surface 42.

Returning to FIG. 1, the spindle 12 comprises a generally cylindrical small diameter member 40 defining a first exterior surface 42, and a plurality of ridge members 44*a–f* extending outwardly from the first exterior surface 42. The spindle 12 is preferably molded from a plastic material so that the member 40 and ridge members 44*a–f* are a one piece unit, with the spindle 12 being molded around the shaft 16 to connect the spindle to the shaft.

The respective lengths of the member 40 and ridge members 44*a–f* are greater than the distance between the ends 22, 24 of the cylinder 20 such that when the cylinder 20 is disposed on the spindle 12, an end of the member 40 and the ends of the ridge members 44*a–f* extend beyond the end 22 of the cylinder 20, as shown in FIG. 2.

With particular reference to FIG. 1, the ridge members 44*a–f* will now be described. The ridge members 44*a–f* are identical to each other so only the ridge member 44*b* will be described in detail. The ridge member 44*b* comprises a pair of sidewalls 46 that are connected to and extend outwardly from the first exterior surface 42, and an outer wall 48 between the sidewalls 46. The sidewalls 46 and outer wall 48 extend adjacent to, but stop short of, the end 50 of the member 40 thereby leaving a cylindrical strip of the first exterior surface 42 adjacent the end 50. Further, the ends of the sidewalls 46 adjacent the end 50 angle toward each other so that the ridge members 44*a–f* adjacent the end 50 are tapered, thereby forming angled guide surfaces 52. In addition, a portion 54 of the outer wall 48 adjacent the guide surfaces 52 is slightly curved. The outer wall 48, together with the outer walls of the other ridge members, defines a second exterior surface 56 (see FIG. 3) having a diameter greater than the diameter of the first exterior surface 42.

As seen in FIGS. 1 and 3, the ridge members 44*a–f* are spaced from each other so that the facing sidewalls 46 of adjacent ridge members define a plurality of channels 58. The number of channels 58 corresponds to the number of ribs 30*a–f*, and the channels 58 are sized to receive the ribs 30*a–f* therein as shown in FIGS. 2 and 3. Stops 60 are provided at the ends of the channels 58 against which the ends of the ribs 30*a–f* abut when the cylinder 20 is fully disposed on the spindle 12. The stops 60 thereby limit travel of the ribs 30*a–f* within the channels 58 and properly position the core 10 on the spindle 12. Further, the base of each channel 58 is defined by the first exterior surface 42.

The spacing between each facing sidewall 46 is only slightly greater than the width w of the ribs 30*a–f*, so that the ribs 30*a–f* are received within the channels 58 with minimal play or spacing between the surfaces of the ribs and the sidewalls, as best seen in FIG. 3. As a result, little relative movement is permitted between the core 10 and the spindle 12. This will minimize the eccentricity and backlash between the spindle 12 and the core 10.

To insert the core 10 onto the spindle 12, the core 10 is simply slid onto the spindle 12. The guide surfaces 52 of adjacent ridge members help guide the ribs 30*a–f* into the channels 58 so that precise alignment of the ribs and channels prior to sliding the core onto the spindle 12 is not necessary. When fully inserted onto the spindle 12, the ends of the ribs 30*a–f* engage the stops 60.

As illustrated in FIG. 3, when the core 10 is inserted onto the spindle 12, the inner edges 32 of the ribs 30*a–f* are spaced from the first exterior surface 42 which defines the base of each channel 58, thereby leaving a space 62 between each inner edge 32 and the first exterior surface 42. The spaces 62 allow the core 10 to contract or compress radially when used ribbon 14 is wound onto the core 10. The size of the spaces 62 is chosen so that, at the maximum anticipated extent of contraction of the core 10, the inner edges 32 remain spaced from the first exterior surface 42. Therefore, when the core 10 is contracted, there is no contact between the inner edges 32 and any exterior surface portion of the spindle 12. As a result, as the core 10 is contracted radially by the ribbon 14, the core is not squeezed onto the spindle 12. When it comes time to remove the core from the spindle, the core slides off the spindle just as easily as it was slid onto the spindle. At the same time, the ribs 30*a–f* disposed within the channels 58 ensure that the core 10 can be rotated by and be positioned concentric to the spindle 12 as the spindle is rotatably driven.

FIG. 3 further illustrates the core 10 as including a plurality of projections 70 between adjacent pairs of the ribs 30*a–f*. In the illustrated embodiment, three projections 70 are provided. However, a smaller number of projections, including a single projection, and a larger number of projections could be used. The projections 70 are disposed adjacent the end 24 of the cylinder 20 and extend only a short distance along the length of the core, as illustrated in dashed lines in FIG. 2. The projections 70 extend radially inward from the interior surface 28 a distance that allows the core 10 to be slid onto the spindle 12, and so that the inner edges of the projections are separated from the exterior surface 56 defined by the ridge members 44*a–f*.

Attached to each projection 70, and extending on either side thereof, are flaps 72, 74, as evident from FIG. 3. Preferably, the flaps 72, 74 are integrally formed with the projections 70, although it is possible to form the flaps separately from the projections 70 and to secure the flaps to the projections using a suitable fastening mechanism, for example glue. The flaps 72, 74 have inner edges that, like the inner edges of the projections 70, are sized so that they are spaced from the exterior surface 56 defined by the ridge members 44*a–f* when the core 10 is inserted onto the spindle 12. The thickness of the flaps 72, 74 is less than the length of the projections 70. In addition, the end surfaces of the ribs 30*a–f*, the end surfaces of the projections 70 and the flaps 72, 74 lie in a single common plane.

The flaps 72, 74 provide surface area upon which data pertaining to the core 10 can be secured. For example, data identifying the supplier of the core 10 and/or ribbon material can be provided on the flaps. A variety of additional data can be stored on the flaps, including, but not limited to, data pertaining to ribbon type, what type(s) of machine the core 10 can be used with, manufacturing data, etc. The data is preferably written indicia provided on the flaps 72, 74.

As described above, the inner edges of the projections 70 and flaps 72, 74 are spaced from the exterior surface 56 of the core 10. The spacing is such that, when the core contracts, the projections 70 and flaps 72, 74 do not contact the exterior surface 56. Therefore, removal of the core 10 from the spindle 12 is not hindered. It is to be realized, however, that the core 10 can be used without the projections 70 and flaps 72, 74 if desired.

The above specification, examples and date provide a complete description of the invention. Many embodiments of the invention, not explicitly described herein, can be made without departing from the spirit and scope of the invention.

What is claimed is:

1. A combination comprising:

a core that is configured to receive ribbon material thereon, the core including:

a) a hollow cylinder having a first open end and a second open end, an exterior surface upon which ribbon material is to be wound, and an interior surface; and b) a plurality of circumferentially spaced ribs connected to and extending inwardly from the interior surface;

a spindle that is configured to receive the core thereon, the spindle including:

a) a cylindrical member having a first exterior surface; and b) a plurality of ridge members extending outwardly from the first exterior surface, each said ridge member having sidewalls and an outer wall between the sidewalls, the outer walls of the ridge members define a second exterior surface, and the ridge members are spaced from each other so that facing sidewalls of adjacent ridge members define a channel between each adjacent ridge member;

wherein the channels are sized to receive the ribs in close fitting relation, and, when the core is disposed on the spindle, a gap is provided between an inner edge of each rib and a base of each channel.

2. The combination of claim 1, wherein the ribs extend radially inwardly a first distance, and the first distance is small enough so that when a ribbon material is wound onto the cylinder, a gap remains between the inner edges of the ribs and the base of each channel.

3. The combination of claim 1, wherein the sidewalls of each ridge member include end portions that angle toward each other adjacent an end of the cylindrical member.

4. The spindle of claim 1, further including a stop at an end of each channel.

5. A spindle for receiving a core thereon, comprising:

a cylindrical member having a first exterior surface; and a plurality of ridge members extending outwardly from the first exterior surface, each said ridge member having sidewalls and an outer wall between the sidewalls, the outer walls of the ridge members define a second exterior surface, and the ridge members are spaced from each other so that facing sidewalls of adjacent ridge members define a channel between each adjacent ridge member, and a stop at an end of each channel.

* * * * *